US006273381B1

(12) United States Patent
Riblet

(10) Patent No.: US 6,273,381 B1
(45) Date of Patent: Aug. 14, 2001

(54) LOAD ACTUATED LOCK

(75) Inventor: Henry J. Riblet, Melvin Village, NH (US)

(73) Assignee: Redev Management Corporation, Melvin Village, NH (US)

( * ) Notice: Subject to any disclaimer, the term of this patent is extended or adjusted under 35 U.S.C. 154(b) by 0 days.

(21) Appl. No.: 09/386,730

(22) Filed: Aug. 31, 1999

(51) Int. Cl.[7] ..... A47G 29/02

(52) U.S. Cl. ..... 248/248; 248/246; 248/235

(58) Field of Search ..... 248/248, 246, 248/219.4, 300, 240, 247, 235, 240.3; 211/135, 193

(56) References Cited

U.S. PATENT DOCUMENTS

| | | | | |
|---|---|---|---|---|
| 351,143 | * | 10/1886 | Whittingham | 248/246 |
| 901,926 | * | 10/1908 | Watt | 248/235 |
| 1,416,296 | * | 5/1922 | Hoitsma | 182/136 |
| 1,441,806 | * | 1/1923 | Hoitsma | 182/136 |
| 1,487,798 | * | 3/1924 | Nowicki | 248/246 |
| 2,038,899 | * | 4/1936 | Hoitsma | 182/148 |
| 2,244,374 | | 6/1941 | Riblet . | |
| 2,342,427 | | 2/1944 | Riblet . | |
| 2,605,074 | * | 7/1952 | Bucsko et al. | 248/235 |
| 2,801,851 | * | 8/1957 | Meek | 428/76 |
| 2,854,293 | | 9/1958 | Riblet . | |
| 3,473,774 | | 10/1969 | Riblet . | |
| 3,970,277 | | 7/1976 | Riblet . | |
| 4,103,856 | * | 8/1978 | Riblet | 248/246 |
| 4,597,471 | * | 7/1986 | Anderson | 182/136 |
| 4,598,794 | * | 7/1986 | Anderson | 182/113 |
| 5,257,766 | | 11/1993 | Riblet . | |
| 5,535,974 | * | 7/1996 | Savitski | 248/246 |
| 5,845,743 | * | 12/1998 | Dechant | 182/187 |
| 5,941,486 | * | 8/1999 | Riblet | 248/219.4 |
| 6,126,127 | * | 10/2000 | Riblet | 248/219.4 |

* cited by examiner

*Primary Examiner*—Anita M. King
*Assistant Examiner*—N. Morrison
(74) *Attorney, Agent, or Firm*—Kriegsman & Kriegsman

(57) ABSTRACT

A bracket assembly includes an angle bracket having a horizontal leg, a diagonal leg and a vertical leg. A lower bracket arm and a lock are coupled to the angle bracket and cooperate to mount the angle bracket onto an upright. The lock includes a pair of side members pivotally coupled to the angle bracket by a fulcrum bar. The pair of side members include a first pair of openings for an outer jaw and a second pair of openings, the second pair of openings being disposed, in the case of a load activated lock, beneath the plane defined by the fulcrum bar and the first pair of openings. The lock further includes an outer jaw disposed through the first pair of openings in the side members. The outer jaw is shaped in lateral cross-section to include an abutment surface and an engagement surface. In use, for an upright of standard thickness, the lock rotates so that the abutment surface of the inner or outer jaw frictionally contacts the upright to prevent downward movement of the bracket assembly. For an upright of limited thickness, the lock rotates so that the engagement surface of the inner or outer jaw digs into the upright to prevent downward movement of the bracket assembly. It should be noted that the use of abutment and engagement surfaces on the jaws, even when they are in a common plane with the fulcrum, will also contribute to the safety of the lock.

10 Claims, 6 Drawing Sheets

LOAD ACTUATED LOCK

BACKGROUND OF THE INVENTION

The present invention relates generally to scaffold bracket assemblies and more particularly, to load activated locks for scaffold bracket assemblies.

Angle brackets and bracket assemblies are well known in the art.

Angle brackets typically comprise three main structural components, a horizontal leg, a diagonal leg and a vertical leg, which are configured to define, in load-bearing shape, a substantially triangular bracket. In the art, angle brackets typically fall into two categories, one-piece angle brackets and multiple-piece angle brackets.

In U.S. Pat. No. 5,257,766 to Riblet, there is disclosed an angle bracket constructed from a single piece metal bracket. The bracket is of a substantially triangular shape. In one embodiment of the invention, the bracket has a U-shaped cross-section providing added stability. A method is disclosed for constructing the bracket from the metal blank. The method includes the steps of folding the metal blank along preformed fold sections to form its triangular shape. The method also includes the steps of folding the metal blank along additional preformed fold lines to form its U-shaped cross-section.

Bracket assemblies typically comprise an angle bracket of the type described above, an upper bracket arm and a lower bracket arm. The upper bracket arm and the lower bracket arm are sized and shaped to be mounted on a vertical upright. In use, each of a pair of bracket assemblies is commonly mounted onto an associated upright, such as a post or beam, to create a scaffold. A scaffold is created by placing a horizontal plank across the angle bracket of each bracket assembly.

One type of bracket assembly which is well known and widely used in the art is disclosed in U.S. Pat. No. 2,342,427 to Riblet. The bracket assembly comprises a horizontal leg, a diagonal leg and a vertical leg which are configured to define, in load-bearing shape, a substantially triangular angle bracket. The bracket assembly further comprises an automatic lock which is affixed to the angle bracket at the junction of the vertical leg and the horizontal leg and a lower bracket arm which is affixed to the angle bracket at the junction of the vertical leg and the diagonal leg.

The automatic lock of the bracket assembly comprises a U-shaped band which is pivotally mounted onto the angle bracket about a fulcrum. The automatic lock of the bracket assembly further comprises a cylindrically shaped inner jaw and a cylindrically shaped outer jaw, the inner jaw being disposed beneath the plane defined by the fulcrum and the outer jaw.

The bracket assembly can be mounted on an upright by slidably disposing the bracket assembly so that the upright projects between the inner jaw and the outer jaw. When a load is placed on the horizontal leg of the angle bracket, the resulting force pivots the lock about the fulcrum in a counterclockwise direction until the inner and outer jaws abut against the upright in such a manner so as to prevent any downward movement of the bracket assembly along the upright.

Bracket assemblies of this type are highly desirable because the force of the inner jaw and the outer jaw onto the upright is provided entirely by the load on the platform. Specifically, the load creates a frictional force between the outer jaw and the upright which precludes the bracket assembly from sliding down the upright.

Although widely used in commerce, bracket assemblies of this type experience a notable drawback. In particular, it has been found that bracket assemblies of this type function inadequately when mounted on an upright of reduced thickness. Specifically, when a bracket assembly of this type is mounted on an upright of reduced thickness, a considerable amount of rotation of the lock about the fulcrum is required in order for the inner and outer jaws to properly abut against the upright to limit downward movement of the bracket assembly along the upright. Accordingly, it has been found that when the lock is required to rotate so that the outer jaw is disposed above the horizontal plane defined by the horizontal leg and the fulcrum, the outer jaw inadequately engages the upright. As a consequence, the bracket assembly may slide down the upright, which is highly undesirable.

SUMMARY OF THE INVENTION

It is an object of the present invention to provide a new and improved lock for a bracket assembly.

It is another object of the present invention to provide a lock for a bracket assembly which is load actuated.

It is yet another object of the present invention to provide a lock for a bracket assembly of the type described above which securely retains the bracket assembly mounted on a vertical upright.

It is still another object of the present invention to provide a lock for a bracket assembly of the type described above which is strong and which is constructed to withstand heavy loads.

It is another object of the present invention to provide a lock for a bracket assembly of the type described above which is easy to manufacture, has a limited number of parts, and which is easy to use.

Accordingly, in one embodiment of the present invention, there is provided a load actuated lock for mounting an angle bracket on an upright, said load actuated lock comprising a U-shaped member pivotally coupled to the angle bracket, an outer locking jaw fixedly coupled to said U-shaped member, said outer locking jaw comprising an abutment surface and an engagement surface, and an inner locking jaw fixedly coupled to said U-shaped member, said inner locking jaw comprising an abutment surface and an engagement surface.

In another embodiment of the present invention, there is provided a load actuated lock for mounting an angle bracket on an upright, said load actuated lock comprising a U-shaped member pivotally coupled to the angle bracket, an outer locking jaw rotatably coupled to said U-shaped member, said outer locking jaw comprising an abutment surface and an engagement surface, and an inner locking jaw rotatably coupled to said U-shaped member, said inner locking jaw comprising an abutment surface and an engagement surface.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration of various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts:

FIG. 2(*a*) is an enlarged side view of another embodiment of a U-shaped band similarly mounted, the U-shaped band being shown with the fulcrum bar extending therethrough;

FIG. 2(*b*) is an enlarged side view of another embodiment of a U-shaped band similarly mounted, the U-shaped band being shown with the fulcrum bar extending therethrough;

DETAILED DESCRIPTION OF A PREFERRED EMBODIMENT

Figure 1:
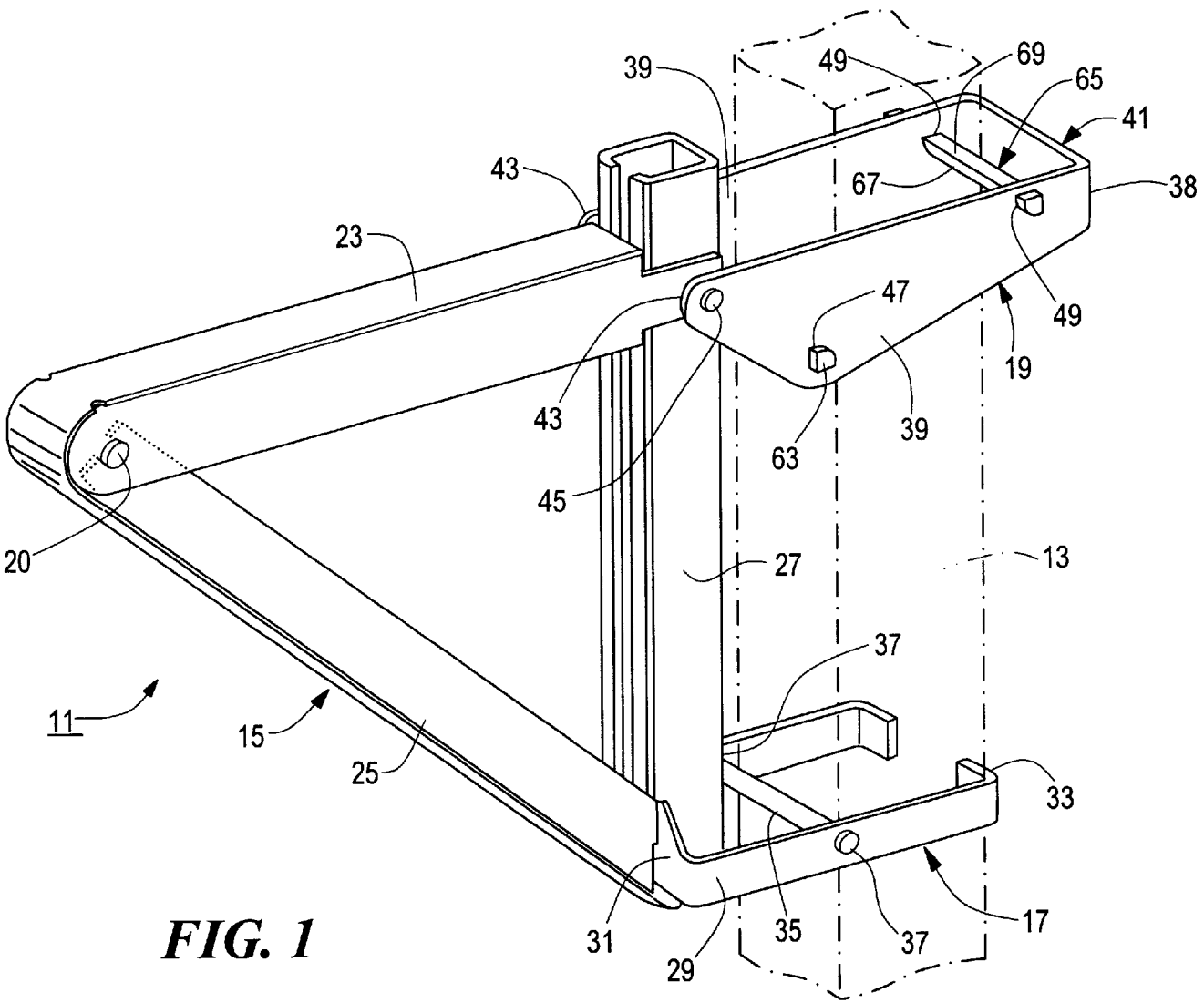
FIG. 1 is a perspective view of a first embodiment of a bracket assembly constructed according to the teachings of the present invention, the bracket assembly being shown mounted on a vertical upright shown in phantom.

Referring now to FIG. 1, there is shown a perspective view of a first embodiment of a bracket assembly constructed according to the teachings of the present invention, the bracket assembly being represented generally by reference numeral 11. Bracket assembly 11 is shown mounted on an upright 13, upright 13 representing an object such as a beam or pole.

Bracket assembly 11 comprises an angle bracket 15, a lower bracket arm 17, a load actuated lock 19 and an anchoring bolt 20. Bracket arm 17 and load actuated lock 19 cooperate to mount angle bracket 15 onto upright 13. In this manner, a pair of bracket assemblies 11 can be used to create a scaffold. Specifically, with each of the pair of bracket assemblies mounted onto an associated upright, a scaffold is created by placing a plank across each angle bracket of the pair of bracket assemblies.

Angle bracket 15 is a substantially triangular bracket comprising a horizontal leg 23, a diagonal leg 25 and a vertical leg 27. Angle bracket 15 is preferably a one-piece angle bracket of the type disclosed in U.S. patent application Ser. No. 08/823,226 to H. J. Riblet, which is incorporated herewith by reference.

It is to be understood that the particular construction of angle bracket 15 is not a principal feature of the present invention. Accordingly, angle bracket 15 could be replaced with alternative types of angle brackets, such as multiple piece angle brackets, without departing from the spirit of the present invention.

Lower bracket arm 17 comprises a generally U-shaped band 29 having a closed end 31 and a partially open end 33. Lower bracket arm 17 is coupled to angle bracket 15 by positioning, or trapping, closed end 31 of band 29 between vertical leg 27 and diagonal leg 25. Positioned as such, lower bracket arm 17 acts in shunting vertical loads on horizontal leg 23 around the junction of vertical leg 27 and diagonal leg 25, which is highly desirable.

Lower bracket arm 17 further includes a cylindrical separator 35 which is disposed within a pair of circular openings 37 formed in band 29. Partially open end 33 and separator 35 cooperate to engage opposing sides of upright 13.

It is to be understood that the particular construction of lower bracket arm 17 is not a principal feature of the present invention. Accordingly, lower bracket arm 17 could be replaced with alternative types of bracket arms without departing from the spirit of the present invention.

Bolt 20 is preferably a notched, or grooved, anchoring bolt of the type disclosed in U.S. patent application Ser. No. 08/823,226 to H. J. Riblet. Bolt 20 is coupled to angle bracket 15 by positioning, or trapping, bolt 20 between horizontal leg 23 and diagonal leg 25. Positioned as such, bolt 20 acts in shunting vertical loads on horizontal leg 23 around the junction of horizontal leg 23 and diagonal leg 25, which is highly desirable.

It is to be understood that the particular construction and functionality of bolt 20 is not a principal feature of the present invention. Accordingly, bolt 20 could be replaced with alternative types of fastening means, such as a screw or a pin, or could be removed entirely from bracket assembly 11 without departing from the spirit of the present invention.

Load activated lock 19 comprises a generally U-shaped band 38 having a pair of side members 39, a closed end 41 and a pair of free ends 43. Side members 39 of U-shaped band 38 are coupled to angle bracket 15 at the junction of horizontal leg 23 and vertical leg 27 by a generally cylindrical fulcrum bar 45. Fulcrum bar 45 extends through side members 39, horizontal leg 23 and vertical leg 27 and serves as a fulcrum point about which load activated lock 19 is free to rotate.

It should be noted that load activated lock 19 is not limited to comprising a generally U-shaped bracket having a pair of side members and a closed end. Rather, U-shaped band 38 could be replaced by alternative members, such as a pair of spaced apart side members, without departing from the spirit of the present invention.

Figure 2:
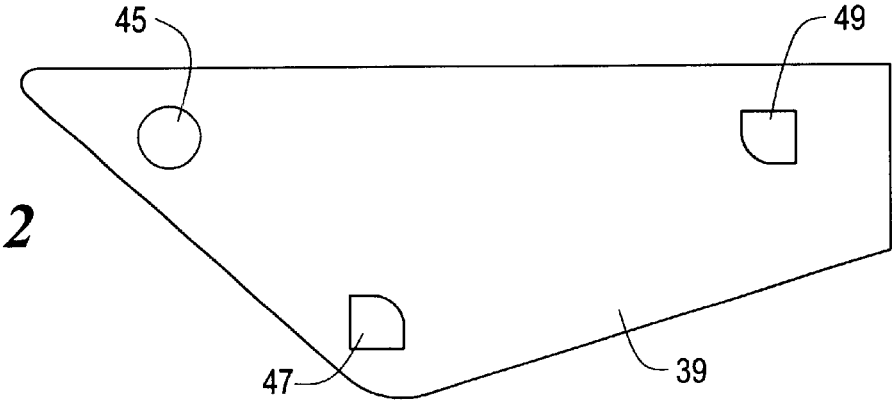
FIG. 2 is an enlarged side view of the U-shaped band shown in FIG. 1 as it might appear mounted on an upright of marginal width, the U-shaped band being shown with the fulcrum bar extending therethrough.
Figure 2:
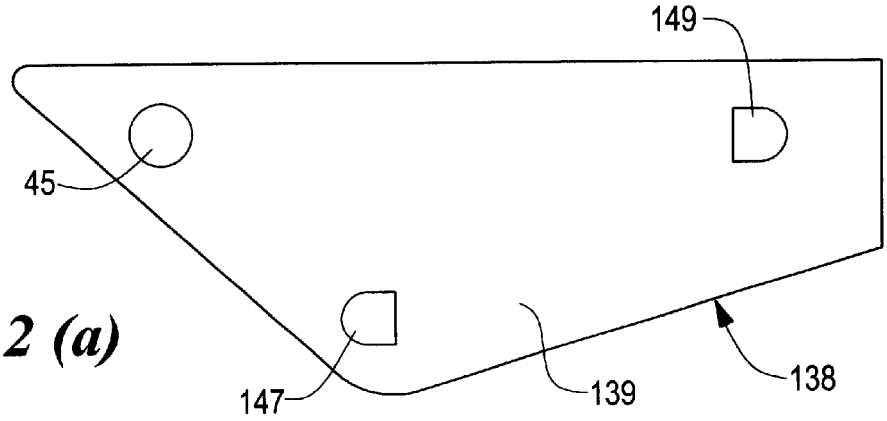
Figure 2:
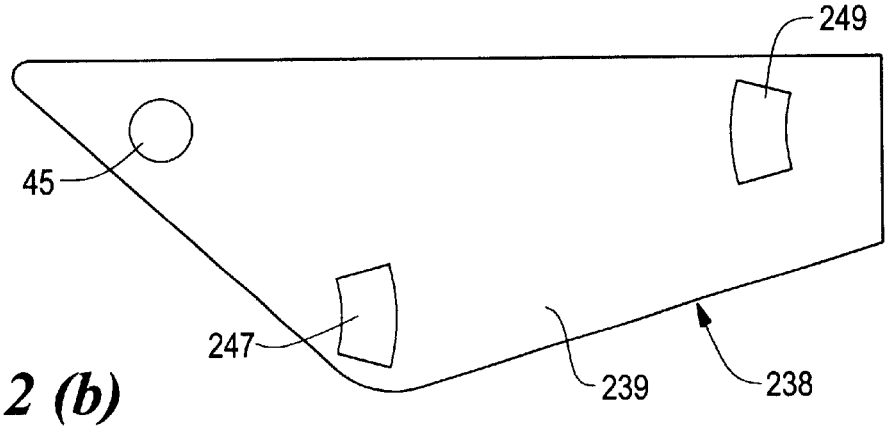
Figure 3:
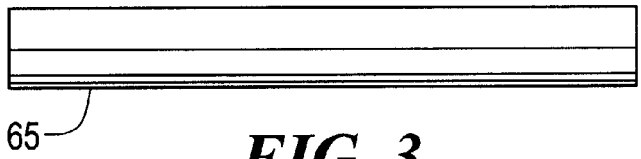
FIG. 3 is an enlarged front view of the outer jaw shown in FIG. 1.
Figure 4:
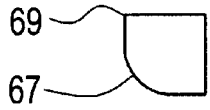
FIG. 4 is a side view of the outer jaw shown in FIG. 3.
Figure 5:
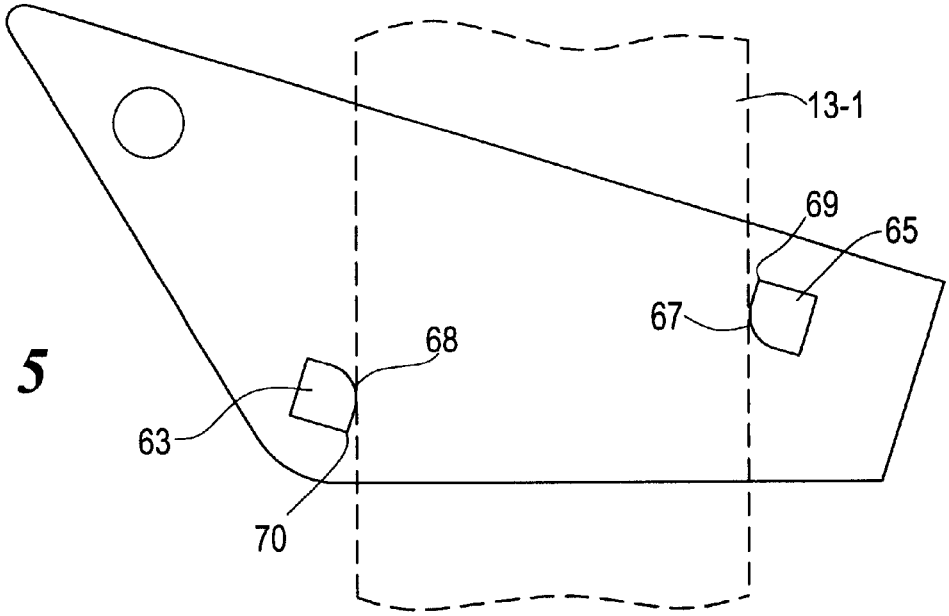
FIG. 5 is an enlarged, fragmentary side view of the load activated lock with the fulcrum bar and the jaws extending through the U-shaped band as shown in FIG. 1, the lock being shown mounted on a vertical upright of standard thickness shown in phantom.

Side members 39 of U-shaped band 38 are shaped to include a first pair of openings 47 and a second pair of openings 49, first pair of openings 47 being disposed beneath the plane defined by fulcrum bar 45 and second pair of openings 49. As shown in FIG. 2, first and second pairs of openings 47 and 49 are shaped to allow for the insertion of a device, such as a locking jaw, therethrough. It should be noted that said locking jaw can be retained in place by cotter pins, C-clips, threaded bolts or other means, not shown.

It should be noted that bracket assembly 11 is not limited to the particular size and shape of side members 39. Rather, side members 39 could be replaced with different sized and shaped side members which are shaped to include openings which differ in size and shape from openings 47 and 49 without departing from the spirit of the present invention.

As an example, in FIG. 2(*a*), there is shown another embodiment of a U-shaped band 138 which could be used in bracket assembly 11 in place of U-shaped band 38. U-shaped band 138 differs from U-shaped band 38 in that U-shaped band 138 comprises side members 139 which include first and second pairs of rounded openings 147 and 149 which differ slightly in shape from first and second pairs of openings 47 and 49, respectively, in U-shaped band 38. The particular shape of rounded openings 147 and 149 allows for the rotational movement of a locking jaw disposed therethrough, as will be described further in detail below.

As another example, in FIG. 2(*b*), there is shown another embodiment of a U-shaped band 238 which could be used in bracket assembly 11 in place of U-shaped band 38. U-shaped band 238 differs from U-shaped band 38 in that U-shaped band 238 comprises side members 239 which include first and second pairs of arcuate slots 247 and 249 which differ significantly in shape from first and second pairs of openings 47 and 49, respectively, in side members 39. The particular shape of arcuate slots 247 and 249 allows for the sliding movement of a locking jaw disposed therethrough, as will be described further in detail below.

Load activated lock 19 further comprises an inner jaw 63 and an outer jaw 65 which are identical in construction and which together engage opposing sides of upright 13 to securely mount bracket assembly 11 thereon. It should be noted that the particular shape of inner jaw 63 and outer jaw 65 creates numerous functional advantages and accordingly serves as a principal feature of the present invention.

Inner jaw 63 is disposed through openings 47 in side members 39 and is capable of very limited rotational movement relative to members 39. Similarly, outer jaw 65 is disposed through openings 49 in side members 39 and is capable of very limited rotational movement relative to members 39. However, it should be noted that inner and outer jaws 63 and 65 could alternatively be fixedly disposed in side members 39 without departing from the spirit of the present invention.

Referring now to FIGS. 3–6, outer jaw 65 is an elongated member which is generally square shaped in lateral cross-section with one rounded corner. Outer jaw 65 comprises an abutment surface 67, which is in the form of a rounded wall, and an engagement surface 69, which is in the form of a sharp corner. Inner jaw 63, which is similar in construction with outer jaw 65, similarly comprises an abutment surface 68, which is in the form of a rounded wall, and an engagement surface 70, which is in the form of a sharp corner.

It should be noted that the shape of abutment surfaces 67 and 68 are not limited to the shape of a rounded wall. Rather, abutment surfaces 67 and 68 could be alternatively shaped without departing from the spirit of the present invention. For example, abutment surfaces 67 and 68 could be in the form of a convex surface smooth enough so as not to mark the surface of the upright over its range of safe thicknesses without departing from the spirit of the present invention.

It should also be noted that the shape of engagement surfaces 69 and 70 are not limited to the shape of a sharp corner. Rather, engagement surfaces 69 and 70 could be alternatively shaped without departing from the spirit of the present invention. For example, engagement surfaces 69 and 70 could be in the form of a knurled, curved surface without departing from the spirit of the present invention.

In use, inner jaw 63 and outer jaw 65 together cooperate to enable bracket assembly 11 to be mounted onto upright 13 in the following manner. Specifically, inner jaw 63 and outer jaw 65 are disposed on opposing sides of upright 13, as shown in FIG. 1. Upon the placement of a load upon horizontal leg 23, the weight of the load acting about separator 35 to exert a horizontal force on outer jaw 65 will rotate load activated lock 19 in a counterclockwise direction so long as outer jaw 65 is below the horizontal plane defined through fulcrum bar 45 until inner jaw 63 and outer jaw 65 frictionally engage upright 13 to prevent any downward motion of bracket assembly 11 on upright 13. As can be appreciated, as long as there is any load on horizontal leg 23, and outer jaw 65 is below the horizontal plane defined through fulcrum bar 45, a frictional force will exist between both outer jaw 65 and inner jaw 63 and upright 13 which prevents downward movement of bracket assembly 11 on upright 13.

It should be noted that for an upright of standard thickness 13–1, side members 39 of load actuated lock 19 pivot in a counterclockwise direction until abutment surface 68 of inner jaw 63 meets upright 13–1 and outer jaw 65 lies along, or beneath, the plane defined by horizontal leg 23 and fulcrum bar 45. With outer jaw 65 positioned as such, abutment surfaces 67 and 68 contact upright 13–1, and the frictional contact between abutment surfaces 67 and 68 and upright 13–1 is sufficient enough to prevent downward movement of bracket assembly 11 on upright 13–1.

Figure 6:
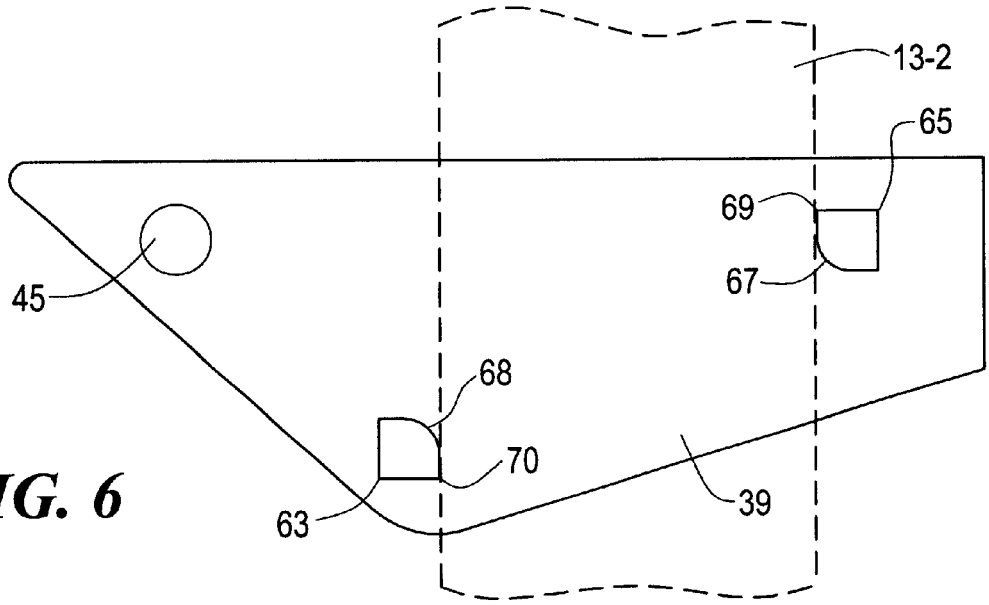
FIG. 6 is an enlarged, fragmentary side view of the load activated lock with the fulcrum bar and the jaws extending thruogh the U-shaped band as shown in FIG. 1, the lock being shown mounted on a vertical upright of marginal thickness shown in phantom.

It should be noted that for an upright of reduced thickness 13–2, side members 39 of load actuated lock 19 will pivot in a counterclockwise direction until outer jaw 65 lies above the plane defined by fulcrum bar 45, as shown in FIG. 6. With outer jaw 65 positioned as such, it has been found that abutment surfaces 67 and 68 may fail to frictionally contact upright 13–2 in a manner which would prevent downward movement of bracket assembly 11 on upright 13–2.

In fact, as is clear from FIG. 6, further rotation of side members 39 in a counterclockwise direction puts engagement surfaces 69 and 70 in contact with upright 13–2. As can be appreciated, having engagement surfaces 69 and 70 rough or sharp enough to dig into and engage upright 13–2 creates two important advantages. As a first advantage, engagement surfaces 69 and 70 dig into upright 13–2 in such a manner so as to increase the amount by which outer jaw 65 may be above the horizontal plane defined through fulcrum bar 45 and still prevent downward movement of bracket assembly 11 on upright 13–2. As a second advantage, engagement surfaces 69 and 70 dig into upright 13–2 in such a manner so as to mark upright 13–2. Marking upright 13–2 notifies the user that upright 13–2 is too narrow for safe use and accordingly, should be discarded.

Although openings 47 and 49 are provided so that rotation of side members 39 rotates inner and outer jaws 63 and 65 so that engagement surfaces 70 and 69, respectively, dig into upright 13–2, it is to be understood that load activated lock 19 is not limited to the use of openings 47 and 49 to create limited rotation of inner and outer jaws 63 and 65. Rather, alternative methods may be employed to cause abutment surfaces 67 and 68 to contact uprights of standard thickness and to cause engagement surfaces 69 and 70 to dig into uprights of limited thickness.

For example, rather than forming openings 47 and 49 which match the shape of inner and outer jaws 63 and 65, respectively, inner and outer jaws 63 and 65 could be welded in place in square holes.

Figure 7:
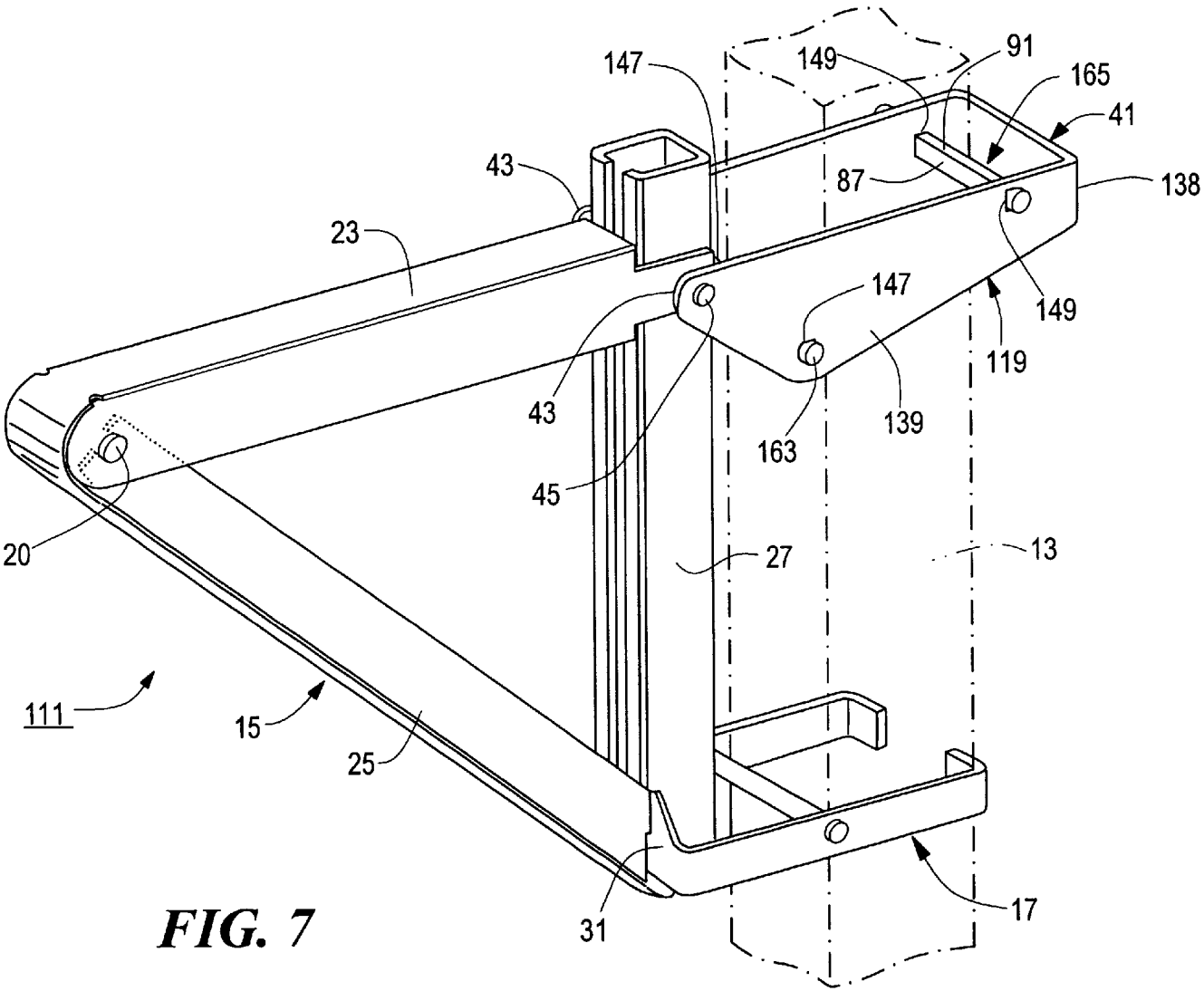
FIG. 7 is a perspective view of a second embodiment of a bracket assembly constructed according to the teachings of the present invention, the bracket assembly being shown mounted on a vertical upright shown in phantom.

Referring now to FIG. 7, there is shown a perspective view of a second embodiment of a bracket assembly constructed according to the teachings of the present invention, the bracket assembly being represented generally by reference numeral 111. Bracket assembly 111 is shown mounted on an upright 113, upright 113 representing an object such as a beam or pole.

Bracket assembly 111 is similar to bracket assembly 11 in that bracket assembly 111 also comprises angle bracket 15, a lower bracket arm 17 and an anchoring bolt 20. Bracket assembly 111 differs from bracket assembly 11 only in the fact that bracket assembly 111 comprises a load activated lock 119 which differs slightly in construction from load activated lock 19 of bracket assembly 11.

Load activated lock 119 comprises inner and outer jaws 163 and 165 which are rotatably disposed within rounded slots 147 and 149, respectively, of U-shaped band 138 and are capable of limited rotation. Inner and outer jaws 163 and 165 of load activated lock 119 may be mounted onto side members 139 by connective means, such as cotter pins, c-clips or bolts.

Figure 8:
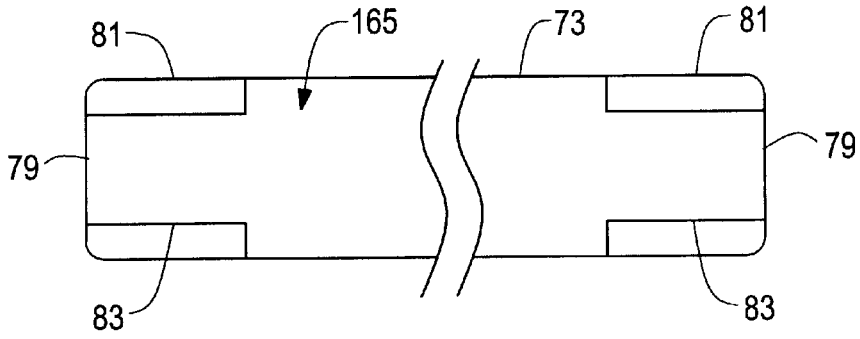
FIG. 8 is an enlarged, fragmentary, front view of the outer jaw shown in FIG. 7.
Figure 9:
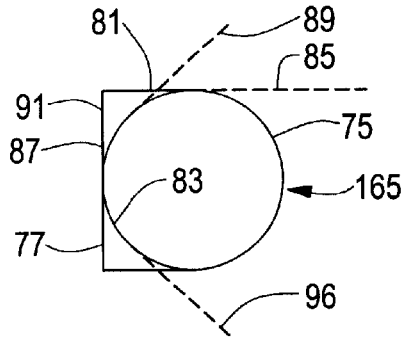
FIG. 9 is a side view of the outer jaw shown in FIG. 8.

For the details concerning the structure of inner and outer jaws 163 and 165, reference is made to FIGS. 8 and 9. FIG. 9 shows, in an end view, outer jaw 165. It should be noted that inner jaw 163 is identical to outer jaw 165 and accordingly, only outer jaw 165 is being described herewith.

The cross-section of central section 73 of jaw 165 is half of circle 75 and half of square 77. This is the shape of openings 147 and 149 in load activated lock 119 and permits the insertion of inner and outer jaws 163 and 165, respectively. Ends 79 of outer jaw 165 have two tangential peaks 81 and 83 which are the intersecting lines of plane surfaces tangent to circle 75. Tangential peak 81 is the intersection of tangential plane 85, perpendicular to face 87 of jaw 165, with tangential plane 89. Tangential peak 83 is the intersection of the tangential plane of face 87 of jaw 165, with tangential plane 91. It is clear that inner and outer jaws 163 and 165, mounted within rounded openings 147 and 149, can be rotated in a counterclockwise direction until tangential peaks 81 and 83 strike the edges of rounded openings 147 and 149. It is also clear that no clockwise rotation of inner and outer jaws 163 and 165 is possible.

Figure 10:
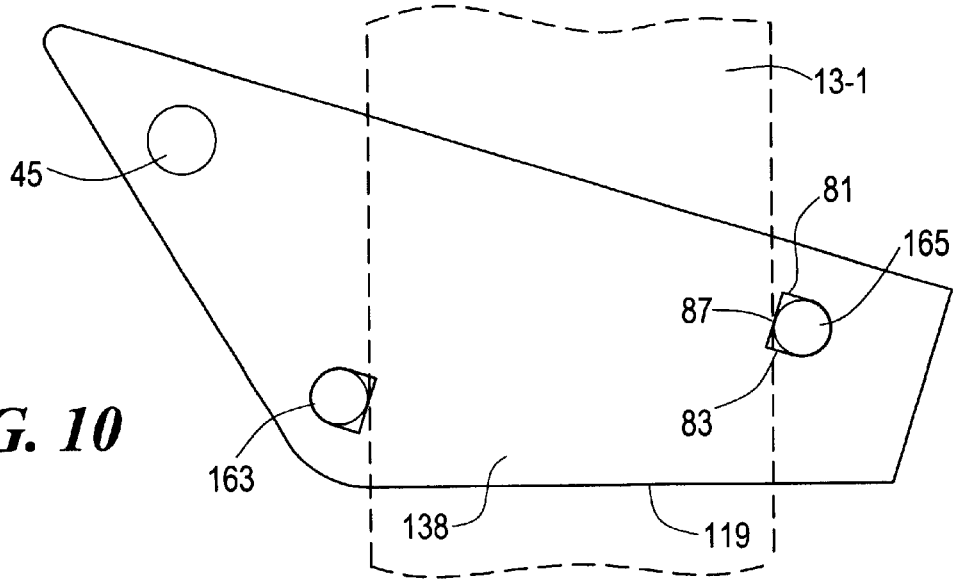
FIG. 10 is an enlarged, fragmentary side view of the load activated lock with the fulcrum bar and the jaws extending through the U-shaped as shown in FIG. 7, the load activated lock being shown mounted on a vertical upright of standard thickness in phantom.

FIG. 10 shows load activated lock 119, with inner and outer jaws 163 and 165 inserted into band 138, mounted on upright 13–1 of sufficient width for safe use. Abutment surface 87 of outer jaw 165 must rest firmly on the surface of upright 13–1. As such, with outer jaw 165 in this position, tangential peaks 81 and 83 will have rotated in a counterclockwise direction.

Replacing upright 13–1 with an upright of decreasing width causes load activating lock 119 to turn in a counterclockwise direction so that the relation of inner and outer locks 163 and 165 within openings 147 and 149 causes abutment surfaces 87 and 88 to maintain contact with the upright until outer jaw 165 is in the horizontal plane defined through fulcrum bar 45. Any further reduction in the width of the upright will force jaws 163 and 165 to also turn in a counterclockwise direction and force engagement surface 91 of jaws 163 and 165 to bite into the upright.

Figure 11:
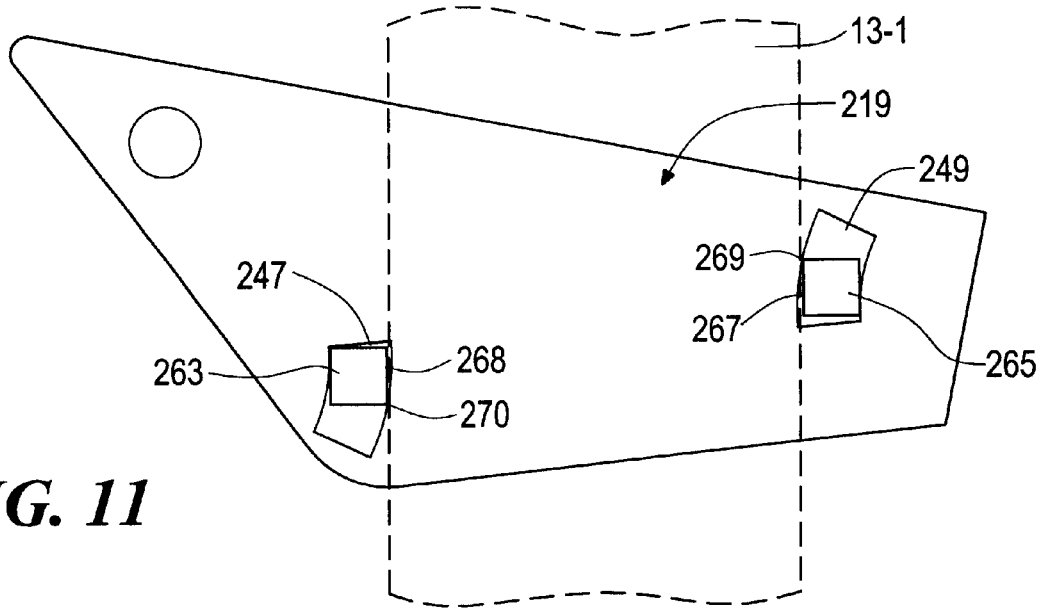
FIG. 11 is an enlarged, fragmentary side view of a third embodiment of a load activated lock constructed according to the teachings of the present invention, the load activated lock being shown with the fulcrum bar and the jaws positioned through the U-shaped band, the load activated lock being shown mounted on a vertical upright of standard thickness shown in phantom.
Figure 12:
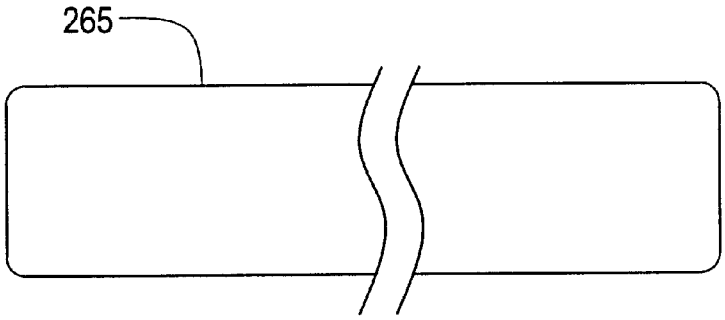
FIG. 12 is an enlarged, fragmentary, front view of the outer jaw shown in FIG. 11.
Figure 13:
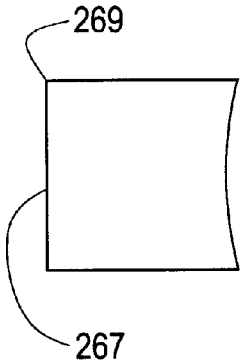
FIG. 13 is a side view of the outer jaw shown in FIG. 11.

It is to be understood that many embodiments of inner and outer jaws 63 and 65 could be utilized in alternative embodiments in load activated lock 119 without departing from the spirit of the present invention. For example, another embodiment of a jaw is shown in FIGS. 12 and 13, the jaw being represented generally by reference numeral 265. Jaw 265 is an elongated member which is generally square shaped with one indented circular wall in lateral cross-section. Jaw 265 comprises an abutment surface 267, which is in the form of a flat wall, and an engagement surface 269, which is in the form of a sharpened corner. Jaw 265 and a jaw 263, identical with jaw 265, can be slid into each of arcuate openings 249 and 247, respectively, in load activated lock 219 which is mounted on upright 13–1 of sufficient width for safe use, as shown in FIG. 11. Abutment surfaces 268 and 267 of jaws 263 and 265, respectively, rest squarely on the surface of upright 13–1. As is clear from FIG. 11, in this position, inner and outer jaws 263 and 265 will slide downward in arcuate openings 247 and 249 as load activated lock 219 rotates in a counterclockwise direction, i.e., during use of lock 219 with uprights of decreasing width. For an upright of reduced width, jaws 263 and 265 will stop sliding downward in arcuate openings 247 and 249 and, in turn, jaws 263 and 265 will be forced to turn in a counterclockwise motion until engagement surfaces 270 and 269 of jaws 263 and 265 bite into the upright.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A lock for mounting an angle bracket on an upright, said lock comprising:

(a) a pair of side members adapted to be coupled to the angle bracket, and (b) an inner jaw and an outer jaw coupled to said pair of side members, (c) at least one of said inner jaw and said outer jaw comprising an abutment surface and an engagement surface, said abutment surface being adapted to selectively abut against the upright and said engagement surface being adapted to selectively engage the upright, said at least one of said inner jaw and said outer jaw being in the form of an elongated member which is generally square shaped in lateral cross-section and which includes a rounded corner.

2. A lock for mounting an angle bracket on an upright, said lock comprising:

(a) a pair of side members adapted to be coupled to the angle bracket, and (b) an inner jaw and an outer jaw coupled to said pair of side members, (c) at least one of said inner jaw and said outer jaw comprising an abutment surface and an engagement surface, said abutment surface being adapted to selectively abut against the upright and said engagement surface being adapted to selectively engage the upright, said at least one of said inner jaw and said outer jaw being in the form of an elongated member which is generally square shaped in lateral cross-section and which includes an inwardly curved wall.

3. A lock for mounting an angle bracket on an upright, said lock comprising:

(a) a pair of side members adapted to be coupled to the angle bracket, and (b) an inner jaw and an outer jaw coupled to said pair of side members, (c) at least one of said inner jaw and said outer jaw comprising an abutment surface and an engagement surface, said abutment surface being adapted to selectively abut against the upright and said engagement surface being adapted to selectively engage the upright, said abutment surface being in the form of a rounded wall.

4. The lock of claim 3 wherein said at least one of said inner jaw and said outer jaw is fixedly coupled to said pair of side members.

5. The lock of claim 3 wherein said at least one of said inner jaw and said outer jaw is capable of limited rotation relative to said pair of side members.

6. The lock of claim 3 wherein said at least one of said inner jaw and said outer jaw is capable of limited sliding relative to said pair of side members.

7. The lock of claim 4 wherein said pair of side members and the abutment and engagement surfaces of said at least one of said inner jaw and said outer jaw are constructed to mark the upright when the width of the upright is less than a predetermined amount.

8. The lock of claim 5 wherein said pair of side members and the abutment and engagement surfaces of said at least one of said inner jaw and said outer jaw are constructed to mark the upright when the width of the upright is less than a predetermined amount.

9. The load activated lock of claim 4 wherein said pair of side members and the abutment and engagement surfaces of said at least one of said inner jaw and said outer jaw are constructed to mark the upright when the width of the upright is less than a predetermined amount.

10. The lock of claim 3 wherein the engagement surface of said at least one of said inner jaw and said outer jaw is in the form of a sharp corner.

* * * * *